US009789383B2

(12) United States Patent
Reguis et al.

(10) Patent No.: US 9,789,383 B2
(45) Date of Patent: Oct. 17, 2017

(54) SLIDING BOARD WHOSE STRUCTURE INCLUDES A VERY FLEXIBLE COMPONENT

(71) Applicant: SKIS ROSSIGNOL, Saint-Jean de Moirans (FR)

(72) Inventors: Adrien Reguis, Grenoble (FR); Arnaud Repa, Le Fontanil Cornillon (FR)

(73) Assignee: SKIS ROSSIGNOL, Saint-Jean de Moirans (FR)

( * ) Notice: Subject to any disclaimer, the term of this patent is extended or adjusted under 35 U.S.C. 154(b) by 0 days.

(21) Appl. No.: 14/956,958

(22) Filed: Dec. 2, 2015

(65) Prior Publication Data

US 2016/0151698 A1 Jun. 2, 2016

(30) Foreign Application Priority Data

Dec. 2, 2014 (FR) ..... 14 61812

(51) Int. Cl.

| | |
|---|---|
| ***A63C 5/03*** | (2006.01) |
| ***A63C 10/00*** | (2012.01) |
| ***B63B 35/79*** | (2006.01) |
| ***A63C 5/12*** | (2006.01) |

(52) U.S. Cl.

CPC ..... *A63C 5/03* (2013.01); *A63C 5/122* (2013.01); *A63C 5/126* (2013.01); *A63C 10/00* (2013.01); *B63B 35/7909* (2013.01); *A63C 2203/10* (2013.01)

(58) Field of Classification Search

None

See application file for complete search history.

(56) References Cited

U.S. PATENT DOCUMENTS

| | | | | |
|---|---|---|---|---|
| 4,995,631 A * | 2/1991 | Hunter | ..... | A63C 5/03 280/14.22 |
| 5,769,445 A * | 6/1998 | Morrow | ..... | A63C 5/03 280/14.21 |
| 2010/0129590 A1 | 5/2010 | Yeh | | |

FOREIGN PATENT DOCUMENTS

| | | |
|---|---|---|
| DE | 102005049478 | 4/2007 |
| FR | 2267129 | 11/1975 |
| JP | H09103533 | 4/1997 |
| WO | 2006085004 | 8/2006 |

* cited by examiner

*Primary Examiner* — John Walters
*Assistant Examiner* — Hilary L Johns
(74) *Attorney, Agent, or Firm* — Meunier Carlin & Curfman LLC

(57) ABSTRACT

Sliding board (1), whose internal structure has a core (2) edged with side ski edges (10), said core (2) separating two lower (3) and upper (4) reinforcing layers, in which core (2) includes at least additional component (20) made of material with greater flexibility than the remainder of the core, characterised in that said additional component is inserted into a slender hollow (21, 22) shaped to curve inside the core.

12 Claims, 2 Drawing Sheets

SLIDING BOARD WHOSE STRUCTURE INCLUDES A VERY FLEXIBLE COMPONENT

TECHNICAL DOMAIN

The invention concerns the domain of sliding sports on snow or water, and in particular, more specifically, the domain of snow sliding boards used for downhill skiing, in particular on packed slopes, whether for downhill skis or snow boards, or boards intended for water sports, such as surfing or kite surfing. The invention aims more particularly at an internal structure of this type of board, endowing it with advantageous mechanical properties.

BACKGROUND OF INVENTION

In general, snow sliding boards, whether they are skis or surf boards, have an internal structure comprising essentially a core separating two lower and upper reinforcing layers. These reinforcing layers render the board rigid, in particular with respect to longitudinal bending rigidity and twisting stiffness, ensuring the transmission of the forces generated by the user to the ski edges. Indeed, when the user makes a turn, or more generally does not slide with the board flat on the snow, the board inclines on its ski edge through which it applies the forces generated by the user to the snow. For the turn to be controlled as efficiently as can be, these forces must be transmitted as directly as possible from the upper face of the board to the ski edge, via the upper reinforcement, the core and the lower reinforcement. This makes it evident that the use of particularly rigid structures improves this transmission.

However, the reaction caused by the snow against the board causes vibrations, increasing as the surface of the snow becomes more rigid, in the case of hard, packed or frozen snow, or when the surface is regular. The direct transmission of this reaction can cause the user some discomfort.

OUTLINE OF INVENTION

It is evident that a trade-off must be found between the optimal transmission of the forces directed towards the ski edge on the one hand, and a comfortable feeling on the other, to prevent excessive vibration perturbing the user. Accordingly, the Applicant has designed a snow sliding board, whose internal structure has a core lined with side edges, which core separates at least two lower and upper reinforcing layers, and in which the core includes at least one additional component, consisting of a material with greater flexibility than the remainder of the core.

In accordance with the invention, this board is characterized in that this additional component is slender and curved in a plane parallel to the lower face of the board.

In other words, the invention consists in integrating into the core a more flexible component, in particular an elastomer type component, having greater deformation capability than the rest of the core, and separating the core into at least two distinct regions. In other words, the sliding board conforming to the invention includes, in its core, a more flexible component endowing the board with local deformation capabilities. This additional component is housed in a hollow in the core which is not in a straight line but curves, with the curve falling into a plane parallel to the sliding base forming the lower face of the board, when the camber of the board, if any, is cancelled out, for instance on a horizontal plane. In other words, this additional component curves in a more or less horizontal plane, once the camber of the board has been cancelled out. Thanks to the curved shape of this additional component, the intrinsic mechanical properties of the board are modified in its specific zones near the additional component, with a gradual effect both for longitudinal and transversal bending stiffness, and for twisting stiffness.

Accordingly, the discontinuity of the core formed by the characteristic additional component ensures some isolation between the two regions separated in this way, while preserving good transmission of the forces.

Naturally, different configurations and locations can be considered for the additional component.

Accordingly, in a first embodiment, one fraction of the additional component can be tilted at an angle with respect to the longitudinal centreline of the board, at an angle included between 5° and 85°. In this configuration, the additional component locally modifies the longitudinal and lateral bending rigidity and the twisting rigidity. This facilitates structural bending movements on an axis which is not parallel to the longitudinal axis of the board. The tilting of this additional component means that the bending rigidity (transversal or longitudinal) changes gradually according to the location of the forces applied by the user. Accordingly, the impact of the properties of the additional component on the transversal and longitudinal bending rigidity affect a more extended zone than if the additional component were orientated in a purely longitudinal or transversal direction. Further, because this additional component is inclined, it avoids the forming of excessively high stress concentration zones, in a purely longitudinal and/or transversal direction, thus avoiding the weakening of the mechanical strength of the structure.

In another embodiment, the additional component can extend over the complete length of the board along the side line. In this case, local deformation of the board at the ski edge is permitted, by transversal bending, so that the ski edge better matches the ground, while limiting the transmission of vibration, producing a sensation of damping and comfort.

In one particular embodiment, the additional component may extend at the ends of the board, following their outer profiles. In other words, the additional component has a shape which curves strongly into the main surface of the board, following the outer contour form of the tip and/or of the heel.

In another configuration, the additional component may extend more or less from one side of the board to the other. In this case, the additional component separates two zones of the board located at different longitudinal levels. When the additional component crosses the entire width of the board, it acts as a hinge, generating local flexibilities and damping effects.

In practice, the additional component can adopt a configuration in which it includes two regions whose directions deviate angularly by more than 20°. In other words, the additional component, which has a slender shape, has a longitudinal axis which curves and whose tangents are engaged in two consecutive and distinct regions either side of a curved zone, and in the horizontal zone, forming an angle of more than 20° with respect to each other.

In practice, the additional component may have a concavity orientated towards the centre of the board. In other words, the additional component may have a Vee-shape or a similar shape the point of which is orientated towards the tip if the additional component is located at the front end of the board, or near the heel, if the additional component is located in the rearmost part of the board.

In another configuration, the additional component may have a concavity orientated towards the centre of the board. In other words, the additional curved component may have a Vee shape or a similar shape, the point of which is orientated towards the centre of the board while the two arms of the Vee are orientated towards the side edges of the board. Similar more rounded shapes, similar to circle arcs, are also possible.

In practice, this additional component may open out on one lateral side of the core near the ski edge. In other words, the core has a discontinuous zone immediately next to the ski edges. In this case, an additional local deformation is formed, generating a more efficient carving point at the ski edge near the additional component.

In one particular configuration, the additional component may have a region which has an undulating shape. In other words, this additional component has a geometry in which the curve is orientated alternately either side of the longitudinal axis, again in the horizontal plane. This configuration produces specific behaviour at the ski edge, with alternating over-carving points and additional transversal deformation zones in places.

In one particular application of the invention to snowboarding, or kite surfing, for which the board is wider with room for both of the user's feet, the additional component may partially enclose at least one of the installation zones of a binding.

In other words, on a sliding board which has to binding installation zones, the additional component defines a region enclosing one of these binding installation zones and/or the other.

In a complementary arrangement, this snow board may include supplementary additional components arranged between the binding installation zones in a Vee shape or a similar shape, arranged symmetrically with respect to the longitudinal axis of the board.

BRIEF DESCRIPTION OF FIGURES

The method of producing the invention, and the resulting advantages, are evident from the description of the following embodiments, the attached illustrations include figures in which.

DETAILED DESCRIPTION

Figure 1:
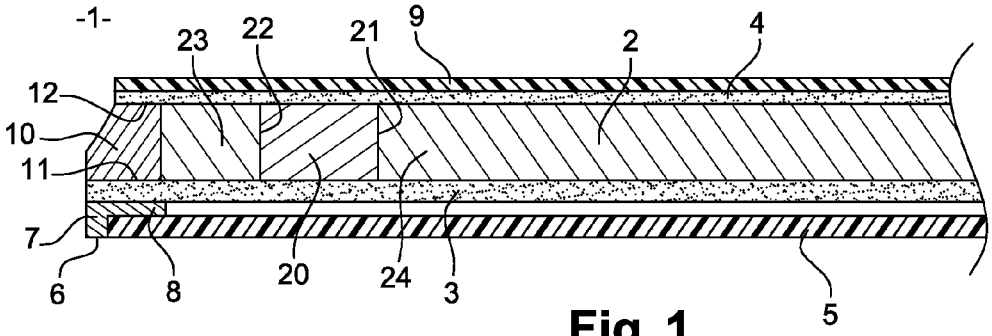
FIG. 1 is a partial sectional view of a sliding board conforming to the invention

Sliding board 1 illustrated in FIG. 1 includes essentially a core 2 separating a lower reinforcing layer 3 from an upper reinforcing layer 4. Lower reinforcing layer 3 rests on base 5, which is edged laterally by ski edges 6 comprising a core 7 and several fins 8.

Upper reinforcement 4 is covered by an upper decoration and protection layer 9. Laterally, the board has an edge component 10 interposed between lower reinforcing layer 3 and upper reinforcing layer 4. This edge component 10 is arranged laterally as an extension of core 2, and is visible from the outside. In the illustrated version, this edge component 10 has a bevelled or trapezoidal shape, wherein the width at the base 11 is smaller than the width of the outer face 12. Nevertheless, the invention covers variants in which the edge components have a rectangular section, or have one face orientated towards the outside, perpendicular to the main plane of the board. The invention also covers variance in the structural embodiments known as "shells" in which none of the edge components 10 are included and in which the upper reinforcing layer 4 extends laterally with upper protection layer 9 as far as near the level of the ski edges 6.

In conformity with the invention, core 2 has a particular structure incorporating an additional component 20, inside a hollow formed between two walls 21, 22, separating the main part of the core 2 from an external portion 23. In this way, additional component 20 is located inside the core and forms one of the components of core 2.

In practice, and as an example, core 2 can be made of wood, or can be also of polymer foam of the polyurethane type. Additional component 20 can be made from a polymer material, in particular an elastomer, such as thermoplastic polyurethane (TPU), or styrene-ethylene-butadiene-styrene (SEBS). This material must have greater flexibility than the essential component material of the core 2, that is, it has a higher compressibility and lower rigidity, measured by Young's modulus. In other words, at the transversal sections of the board where additional component 20 is located, the core has two materials with different rigidities.

In the illustrated form, additional component 20 is therefore in placed in a hollow form through the entire thickness of the core, demarcating in this way two regions 23, 24 arranged either side of additional component 20. The additional element may vary in width but is preferably of a constant width, for manufacturing facility. This width can be included between 5 and 25 mm, preferably between 10 and 20 mm. The additional component can be bonded inside the hollow, without being compressed, to preserve constant three-dimensional density. Additional component 20 is therefore covered on its upper face by at least one reinforcing layer 4 and on its lower face by at least one reinforcing layer 3.

The shape and positioning of this additional component in the core can be variable depending on the desired mechanical properties and on the type of the board on which it is used.

Figure 2:
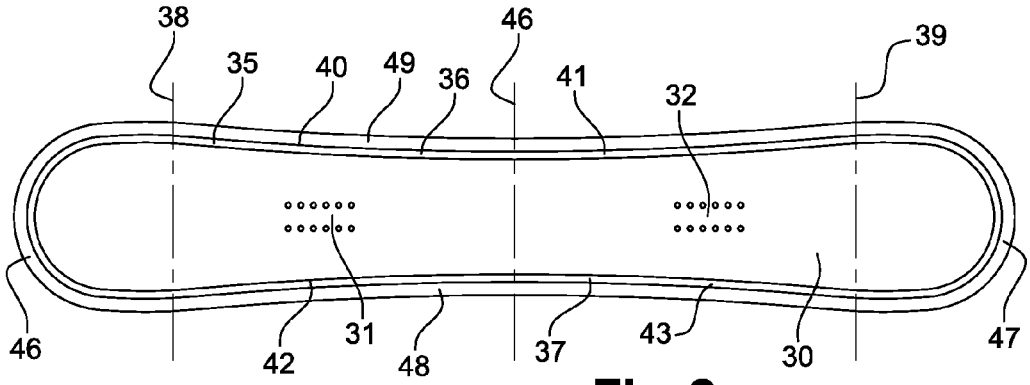
FIGS. 2 and 3 are top views of various alternatives for producing a sliding board according to the invention, in which the characteristic additional component is depicted.

Among the various possible configurations, that illustrated in FIG. 2 is noteworthy, representing a snow surf board 30. This surf board 30 conventionally has two zones 31, 32 in which the bindings are installed. These zones 31 32 are materialized by various drilled holes arranged in parallel lines for the assembly of the binding devices.

In this particular embodiment, the characteristic additional component 35 extends over the entire perimeter of the board while remaining more or less at a constant distance from the lower outer edge of the ski edge and at a constant distance from the edge of the core. In other words, this additional component follows the profile of the side line. With respect to the side of the ski edge, the additional component 35, and more specifically its outer edge, is situated at a distance included between 5 and 30 mm, preferably near 20 mm, for a snow surf board. Accordingly, additional component 35 has two main portions 36, 37 extending approximately between contact lines 38, 39. Each of these portions 36, 37 comprises essentially two segments 40, 41, 42, 43 situated respectively either side of line 46 materialising the transversal middle of the board. These four portions 40-43 are inclined with respect to the longitudinal axis of the board at an angle of around 5° to 10°.

As a complement, additional component 35 extends towards the front and rear by two curved portions 46 47 that follow the contour of the tip and the heel, while staying at a certain distance from the edge of the board, equivalent to that separating the portions 40-43 of the additional component between the contact lines 38,39. Thanks to this arrangement, peripheral portion 48 49 of the board, situated beyond the additional component 35, on the sides of the board, between contact lines 38 39, has a certain local capability of deformation by transversal deflection with respect to the central zone of the board, giving the ski edge an effect of isolation and flexibility with respect to the central part of the board. In addition to this local effect of greater transversal bending flexibility, there is a damping effect because of the shearing generated in the additional component giving the board far softer contact with the snow at the ski edge.

Figure 3:
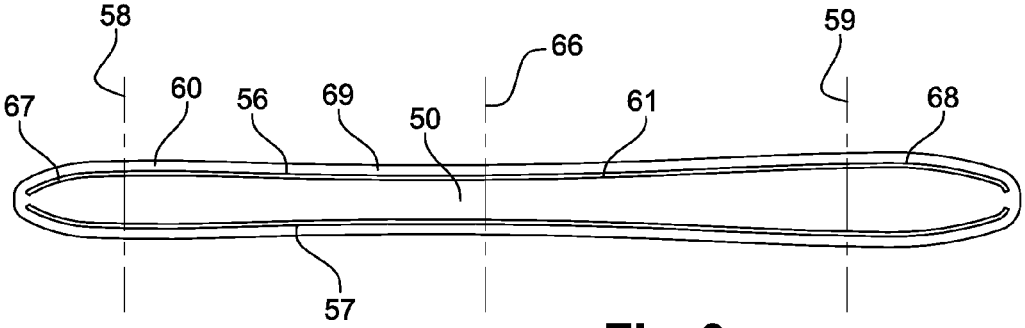

A similar configuration can be used for a downhill ski, as illustrated in FIG. 3. In this case, the ski 50 has two additional components 56 57, situated essentially in the lateral zones. More specifically, component 56 has a first segment 60 extending between rear contact line 58 and line 66 representing the narrowest point of the skate. A second segment 61 extends between line 66 and front contact line 59. With respect to the ski edge, additional component 56, and in particular its outer edge, is at a distance included between 5 and 15 mm, preferably near 10 mm for a ski board. These two segments are situated at a distance of around 10 mm from the outer edge of the board, at the ski edges and therefore follow the side line of the ski. These two segments 60, 61 extend through more curved portions 67,68 arranged behind rear contact line 58 and ahead of front contact line 59. These portions 67 68 were moved away from the outer edge of the board by a distance equivalent to that separating the additional component 56 on the same edge of the board between contact lines 58 59.

In this configuration, portion 69 of the board situated beyond additional component 56 offers some freedom of movement with respect to the remainder of the board, endowing the board with properties of damping and isolation as already referred to, giving it an effect of softness and comfort on the ski edge when the ski is inclined during the turn phases.

Figure 4:
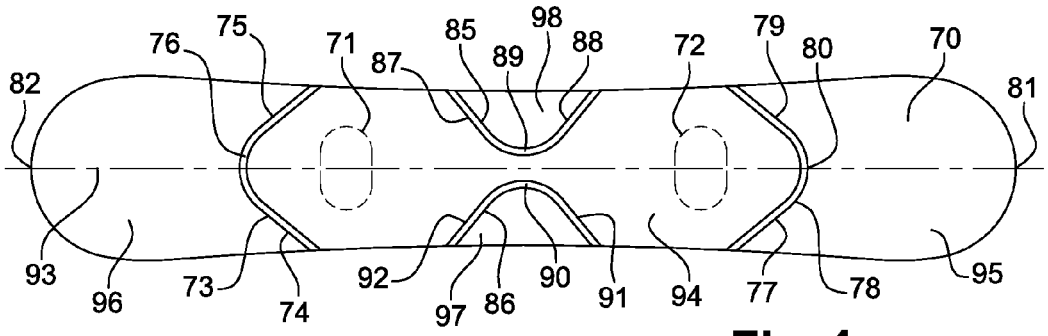
FIGS. 4, 5, and 6 are top views of various alternatives for producing board cores according to the invention, in which the characteristic additional component is depicted.

Another alternative embodiment concerning a snow surf board is illustrated in FIG. 4. This board 70 has two zones for installing bindings 71 72. This board 70 has four characteristics additional components of two different types.

Two of these additional components 73 78 are arranged beyond the installation zone of the bindings 71 72. Each additional component 73 78 is generally Vee-shaped, comprising two segments 74 75 77 79, connected by a curved interconnecting link 76 80. These curved link zones 76 80 are arranged at the middle of the additional component, and are placed at the middle of the board. They are directed towards the end 80, 81 closest to the board. In other words, the additional component has a concavity orientated towards the binding installation zone. The two segments of the same additional component have tangents forming an angle of more than 20° with respect to each other, preferably included between 45° and 135°, and in the illustrated form, near 90°. The segments 74,75,77,79 each open out on the side line. The V-shaped configuration of these additional components 73,78 generally encloses the external part of the binding installation zone 71 72 closest to them.

Thanks to this configuration, when the board is inclined onto a ski edge, the central part 94 of the board is isolated to some extent from the end zones 95, 96, situated beyond the additional components 71,72. Accordingly, this flexibility offers some additional localised torsional capability in the board, and prevents the vibrations generated at the ends 95 96 of the board being transmitted too intensely to the central part 94 where the bindings are installed. The additional components 73, 78 open out flush with ski edges and generate local flexibility zones and therefore the super-grip points on the board.

Additionally, the board also has two supplementary additional components 85 86. Each of these additional components 85 86 also has a generally Vee shaped arrangement comprising two segments 87 88 91 92 opening out laterally at the side line. In other words, the additional component has a concavity orientated towards the outside of the board. The two segments of the same additional component have tangents forming an angle of more than 20° with respect to each other, preferably included between 45° and 135°, and in the illustrated form, near 90°. Each pair of segments 87,88,91, 92 is connected by a curved central portion 89,90, which is orientated towards the longitudinal axis of the board 93.

Thanks to this configuration, the portions 98,97 of the board located outside the additional components 85,86 are mechanically isolated slightly from the central zone 94 in which the bindings are installed. Accordingly, local bending and torsional deformations are modified and the vibrations taken up in the zones 97,98 are not fully transmitted to the central zone 94, and therefore to the foot of the user. This configuration also creates super-grip points at the end of the additional components opening out on the sides of the core.

For downhill piste skiing, the configuration can be adapted by using additional components centred on the longitudinal axis, located in the front and/or rear part of the ski, ahead of and/or behind the area accommodating the binding. The concavity of these additional components can be orientated towards the tip or tail of the board. Independently of the previous configuration, additional components associated in pairs and placed symmetrically with respect to the longitudinal axis of the board can be situated ahead of and/or behind the zone accommodating the binding. Other combinations can be considered.

Figure 5:
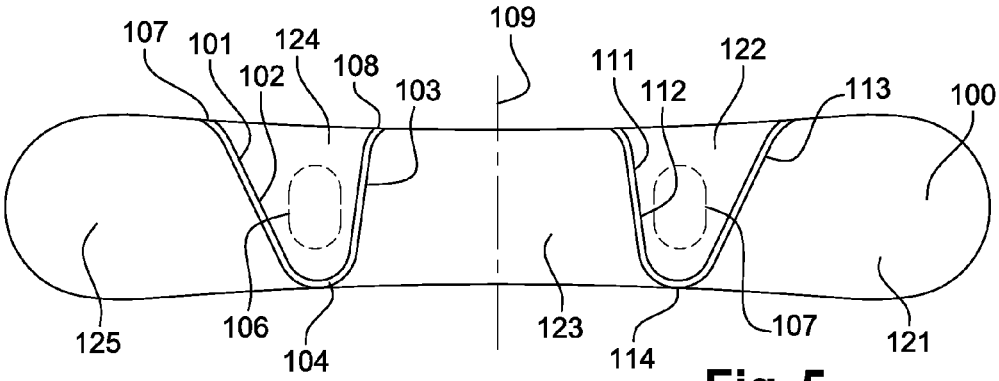

An alternate embodiment is illustrated in FIG. 5 in which the snow surf board 100 has two additional components 101,111, located around the binding installation zones 106, 107, placed symmetrically with respect to the transversal axis 109 marking the centre of the board. More specifically, additional component 101 consists mainly of two segments 102, 103 extending over the entire width of the board, connected by a curved link portion 104 at a tangent to the side line. In the illustrated form, the opposite ends of segments 102, 103 open out onto the opposite side line situated near the tips of the user's feet, with a slightly curved portion 107, 108. The curved portion 104 is level with the ski edge situated at the rear of the user's feet. The angle of inclination between two segments 102, 103 of the same additional component 101 is around 30° to 90°. It will be seen that the inclination of the segment 103, situated between the binding installation zone 106 and the central axis of the board 109 is lower than the transversal axis of the board than that of segment 102 situated between the binding installation zone and the nearest end of the board. The choice of these inclination angles allows a trade-off to be found between the position of the super-grip points on the ski edge and the feeling of comfort.

In the same way, the additional component 111 has two segments 112 113 and a curved linking portion 114 located symmetrically to the other additional component 101 with respect to central transversal axis 109.

This configuration allows five different zones to be demarcated on the board. The two end zones 121, 125 are situated beyond the external segments 102, 113 of the additional components 101. 111. A central zone 123 is defined between the internal segments 103, 112 of the two additional components 101, 111. Two zones 122, 124 are also demarcated inside the additional components 101 111, and form regions integral with the bindings. Thanks to this configuration, when the board is on the front ski edge near the user's toes, vibrations affecting the central zone 123 and the end zones 121, 125 are not entirely transmitted to the regions 122, 124 in which the bindings are installed, resulting in greater comfort for the user. Conversely, when the user applies forces to tilt the board on the rear ski edge, located near his heels, the transmission of these forces by the zones 122, 124 is not entirely towards end zones 121, 125, and central zone 123, thus endowing the board with smoother control. Note that the transmission of forces at the front profile is by four super-grip points whereas only two of super-grip zones appear at the rear ski edge. Accordingly, the sensation of the side line curve radius differs on the front and rear profile edges, with a radius felt at the front being greater than the radius felt at the rear.

Figure 6:
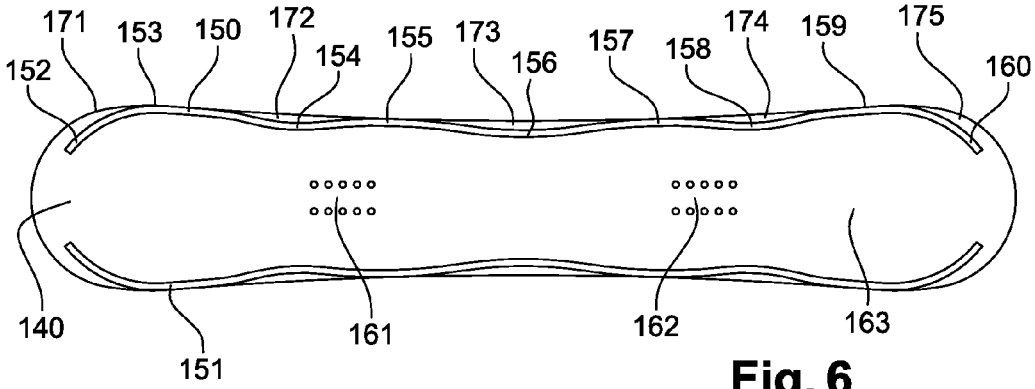

Another alternative illustrated in FIG. 6, in which the board 140, of the snow board type, has two characteristic additional components 151, 152. These two additional components in the illustrated form are symmetrical with respect to the longitudinal axis of the board meaning that only one of the two is described in detail. However, the invention also covers other configurations in which these two components are not absolutely symmetrical.

Additional component 150 has a generally undulating shape with three undulations and extends, near the edge of the core, between the tip and the tail end of the board. The more or less rectilinear regions of the additional component are inclined with respect to the longitudinal axis of the board by an angle of around 5° to 20°. Specifically, this additional component 150 contains zones 153, 155, 157, 159 in which it runs tangent to the edge of the core near the side line. On the outside, and between these tangent zones, the additional component has curved regions 152, 154, 156, 158 and 160 which are offset slightly towards the inside of the core. Note that the zones 155, 157 of the same additional component 150 at a tangent to the edge of the core are situated in the transversal part of the binding installation zones 161, 162. Thanks to this configuration, the additional component defines specific zones 172, 173, 174 of the side line, partially isolated from the rest of the board. Therefore, the forces transmitted by the user apply to the tangent zones 153, 155, 157, 159 which are directly connected mechanically to the central part of the board 163 on which the bindings are installed. In these tangent regions, a super-grip point has been formed at the ski edge because of the upper local deformation. Conversely, the regions situated outside the additional component 150, i.e. the regions 171, 172, 173, 174, 175 are slightly isolated from the centre of the board, allowing additional local transversal deformation and attenuated transmission of the vibrations affecting the ski edge.

From these various configurations it is evident that, at a transversal section of the board, the core can integrate no additional components, or a single additional component, or two additional components, depending on the longitudinal position of this section in the longitudinal direction of the board. A greater number of additional components in a transversal section can be envisioned but while ensuring that the mechanical strength of the board is not weakened locally.

Naturally, the precise positioning of the various undulations in a more or less horizontal plane, and the specific geometry of the surfaces of the isolating zones can be adapted according to the desired type of practice. In particular, for downhill skis, one or several undulations may be contemplated, with one or several super-grip points formed in the base zone. Among the possible variants, it is possible for the additional components to open out not only at the edge of the core but also at the rim of the lateral edge in which a corresponding hollow will be made.

In a complementary manner, the use of a transparent material for the additional component can produce a special visual effect, because it forms a translucent area allowing a fraction of the light to pass through the overall thickness of the board. This effect is particularly advantageous since the components located above and/or beneath the additional components comprise translucent reinforcing layers, a transparent protection layer and a transparent or translucent base.

From the above, it is apparent that boards conforming to the invention offer the advantage of:

- creating super-grip points on the ski edge allowing more efficient control when the additional component opens out onto the side edges of the core,
- modifying the transversal bending capability near the lateral edges of the board when the additional component is moved towards the inside of the core by a distance adjusted to produce softness and comfort.
- locally modifying in the longitudinal and transversal bending capability and the torsional properties gradually along the length of the board when the additional component extends approximately from one side or the other of the core
- separating certain zones of the side line to modify the sensation of the side line radius when the additional component opens out on the lateral edges of the core
- limiting in the same way the transmission of vibration inside the board and creating local damping around the additional component for enhanced comfort and control.

Furthermore, the configurations described for snow sliding boards can also be reproduced for water sliding boards, in particular for kite-surf or surf boards. In this case, the side line of the board will no longer be convex as it is in snow boards but will be concave and the ski edge will not be a separate component from the board base.

The invention claimed is:

1. A sliding board comprising an internal structure, the internal structure comprising a core edged with side ski edges, said core separating a lower reinforcing layer and an upper reinforcing layer, wherein the core comprises a first portion, a second portion and at least one additional component, the additional component positioned between and directly contacting the first portion and the second portion, wherein the first portion is made of the same material as the second portion, wherein the additional component is made of material with greater flexibility than the first portion and the second portion, wherein a lower region of the first portion contacts the lower reinforcing layer, a lower region of the second portion contacts the lower reinforcing layer, an upper region of the first portion contacts the upper reinforcing layer, and an upper region of the second portion contacts the upper reinforcing layer, and wherein the additional component is slender and curved in at least one curve in a plane parallel to the lower face of the board.

2. The sliding board according to claim 1, further comprising a centre-line, wherein at least one fraction of the additional component is inclined at an angle with respect to the longitudinal centre-line of the board, at an angle of between 5° and 85°.

3. The sliding board according to claim 1, further comprising a side line, wherein the additional component runs over an entire length of the board, following the side line.

4. The sliding board according to claim 3, further comprising board ends, wherein the board ends each comprise an outside profile, and wherein the additional component extends at the board ends, following the outside profile of the board ends.

5. The sliding board of claim 1, wherein the additional component has a portion with an undulating shape, including at least two undulations.

6. The sliding board according to claim 1, wherein the core further comprises a first side and a second side, and wherein the additional component extends from one side of the core to the other.

7. The sliding board according to claim 1, wherein the sliding board further comprises a centre, and wherein the additional component has a concavity orientated towards the centre of the board.

8. The sliding board according to claim 1, wherein the sliding board further comprises a longitudinal axis, and wherein the additional component a concavity orientated towards the longitudinal axis of the board.

9. The sliding board according to claim 1, wherein the additional component has at least two regions the directions of which deviate at an angle of more than 20 degrees.

10. The sliding board according to claim 1, wherein the sliding board comprises two additional components in a Vee shape, symmetrically arranged with respect to a longitudinal axis of the board.

11. The sliding board according to claim 1, wherein the additional component opens out on at least one lateral side of the core, near the ski edge.

12. The sliding board according to claim 1, wherein the sliding board is configured for snowboarding or kite surfing in that the additional component partially encloses an installation area of a binding.

* * * * *